United States Patent [19]

Berliner

[11] 4,428,892

[45] Jan. 31, 1984

[54] HUMIDIFIER DEVICE

[76] Inventor: Martin Berliner, 68-37 Yellowstone Blvd., Forest Hills, N.Y. 11375

[21] Appl. No.: 404,603

[22] Filed: Aug. 2, 1982

[51] Int. Cl.[3] ..... B01F 3/04

[52] U.S. Cl. ..... 261/99; 239/51.5; 239/55; 239/58; 261/104; 261/DIG. 14; 261/DIG. 17; 312/31.01; 422/123

[58] Field of Search ..... 261/99, 104, 107, 154, 261/DIG. 14, DIG. 17; 422/4, 5, 123; 239/36, 43, 44, 49, 51.5, 53, 55, 58, 59; 312/31, 31.01, 31.1, 31.2, 31.3; 206/204, 314, 14

[56] References Cited

U.S. PATENT DOCUMENTS

| | | | |
|---|---|---|---|
| 1,273,683 | 7/1918 | Slater et al. | 261/104 |
| 1,732,028 | 10/1929 | Reiner | 239/36 |
| 1,991,581 | 2/1935 | Shelor | 261/107 |
| 2,657,090 | 10/1953 | Meek | 239/55 |
| 2,860,023 | 11/1958 | Herdlitchka | 312/31.1 |
| 3,254,841 | 6/1966 | DeLoncker, Sr. | 312/31 X |
| 3,407,700 | 10/1968 | Hollander | 239/55 X |
| 3,431,038 | 3/1969 | Berliner | 312/31 |
| 3,727,840 | 4/1973 | Nigro | 239/43 |
| 3,754,707 | 8/1973 | Morane | 239/59 |
| 4,258,004 | 3/1981 | Valenzona et al. | 422/123 |

FOREIGN PATENT DOCUMENTS

| | | | |
|---|---|---|---|
| 224313 | 4/1962 | Austria | 261/107 |

*Primary Examiner*—Richard L. Chiesa
*Attorney, Agent, or Firm*—Alexander Mencher

[57] ABSTRACT

A humidifier device to prevent warping, cracking and shrinking of elements in stringed or other musical instruments subject to modification by reason of a lack of moisture in the instrument carrying case. The device comprises a small, sealed housing detachably securable to the interior of the instrument case and provides a refillable and leak-proof reservoir which feeds water or other evaporatable fluid to the top, bottom and inner peripheral side walls of an absorbent ring when the reservoir is filled to capacity; and when partially full and in any position of the carrying case water feed to the absorbent ring is maintained along at least one of the absorbent ring walls. A control ring is further provided which is rotatable about the housing to increase or decrease the evaporation rate of water from the housing ports communicating with the absorbent ring.

8 Claims, 9 Drawing Figures

FIG. 6
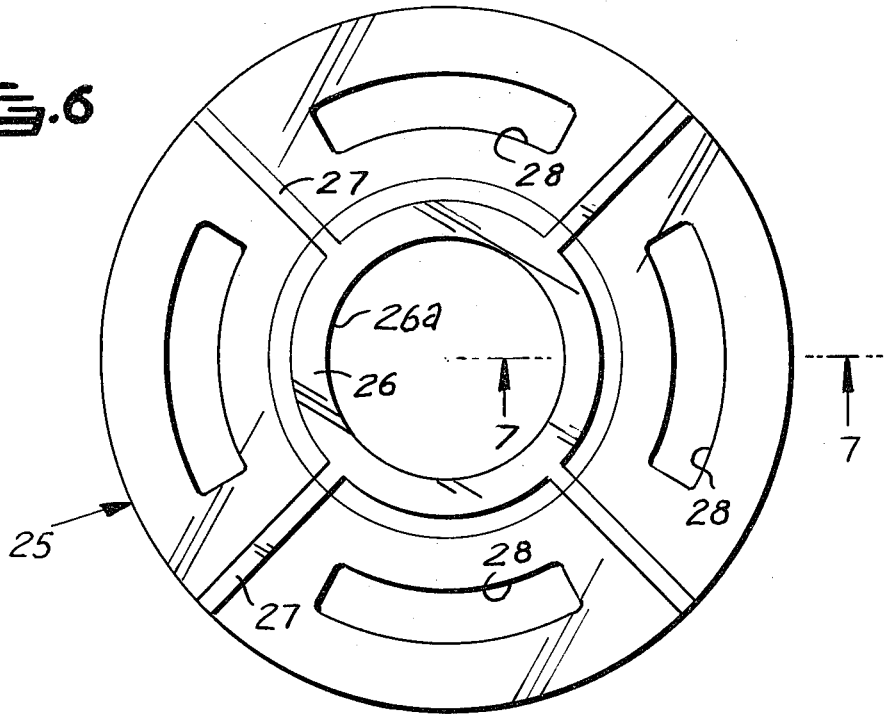
FIG. 7
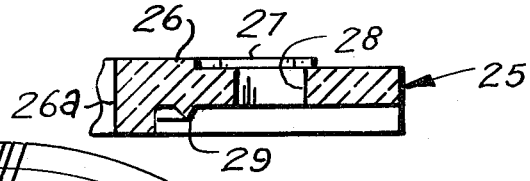
FIG. 8
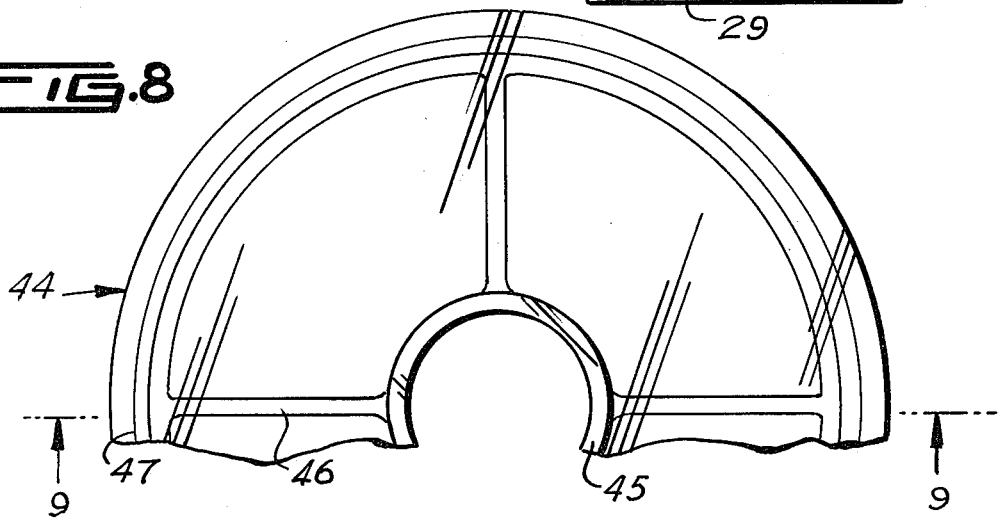
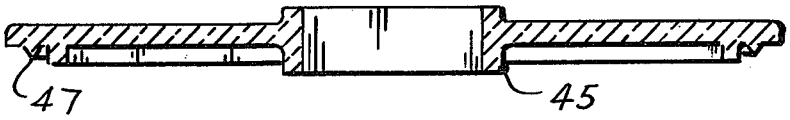
FIG. 9

HUMIDIFIER DEVICE

BACKGROUND OF THE INVENTION

The humidifier device of the instant invention is a structural improvement over presently ascertained prior art and particularly with respect to applicant's prior invention of a humidifier device as disclosed in U.S. Pat. No. 3,431,038 dated Mar. 4, 1969 wherein the absorbent moistening element is in the form of a cylindrical section exposable to the reservoir fluid at one of the ends of said moistening element. The moisture-producing capacity relative to the humidifier size is thus limited especially when applied to musical instrument cases containing wooden elements requiring maintenance of humidity to prevent warpage and cracking as in the violin family as well as in fretted instruments such as guitars, mandolins, lutes and other instruments having wooden components including reeds.

Humidifiers for musical instrument cases in the form of perforated metal containers filled with a water-absorbent material have been attempted as well as the use of humidifiers in the form of snake housings insertable within the sound boxes of instruments such as violins. A snake type humidifier is disclosed in the U.S. patent to Hollander under U.S. Pat. No. 3,407,700 and dated Oct. 29, 1968.

Advantages of applicant's present improved structure reside in increased moisture-producing capacity relative to humidifier size by utilization of ring-type absorbent and compartment elements, novel communicating channels and novel means of attachment to the instrument cases and other types of enclosures, and novel means and ease for refilling of the device.

SUMMARY AND OBJECTS OF THE INVENTION

This invention relates generally to moisture supplying devices, but more particularly to a humidifier device.

A principal object of the invention is to provide a humidifier device for moisture production and which includes particular application to musical instruments to prevent possible cracking, warping and shrinking of stringed instruments including violins and other instruments subject to malfunction and caused by moisture loss.

Another object of the invention is to provide a humidifier device which produces maximum and controlled amount of moisture for size, and which is of such novel structure as to perform efficiently without leakage and in all positions at all times and places including regionally dry and seasonable climates.

Another object of the invention is to provide an improved humidifier device which is of such novel structure and size as to be easily mounted in a musical instrument case while still offering ample clearance for the instrument.

A further object of the invention is to provide an improved humidifier device having a ring-shaped absorbent element liquid-fed on three sides and which includes adjustment means for regulating the amount of moisture produced and emanating from said element to the surrounding area.

A still further object of the invention is to provide a humidor device which is adaptable for other applications such as moisture producing means in humidor space, food containers, and the like.

Another object of the invention is to provide a humidifier device which is adaptable for use in an area requiring a suitable deodorant or other required vaporizing agent.

Other objects of the invention are to provide a humidifier device which is simple in design, inexpensive to manufacture, rugged in construction, easy to use and set-up and operate.

These objects and other incidental ends and advantages of the invention will hereinafter be set forth in the specification and in the appended claims.

BRIEF DESCRIPTION OF DRAWINGS

FIG. 6 is a top plan view of the retaining plate for the absorbent element of the device shown per se and prior to being secured to the assembly;

FIG. 7 is an enlarged cross-sectional view of FIG. 6 taken along the plane 7-7 thereof;

FIG. 8 is a fragmentary top plan view of a modified form of top cover for the device, and FIG. 9 is a cross-sectional view of FIG. 8 taken along the plane 9-9 thereof.

DESCRIPTION OF PREFERRED EMBODIMENT

Figure 1:
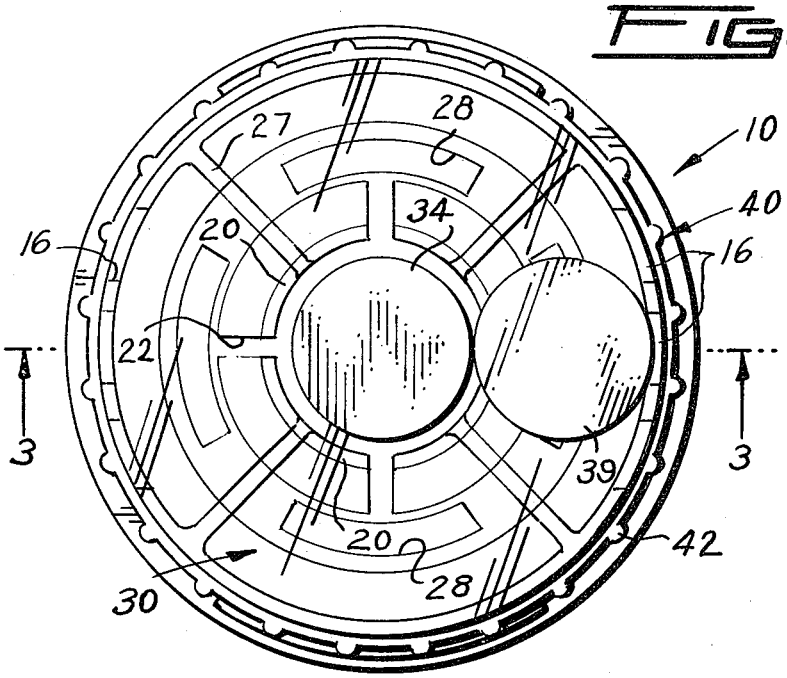
FIG. 1 is an enlarged top plan view of preferred form of the invention.
Figure 2:
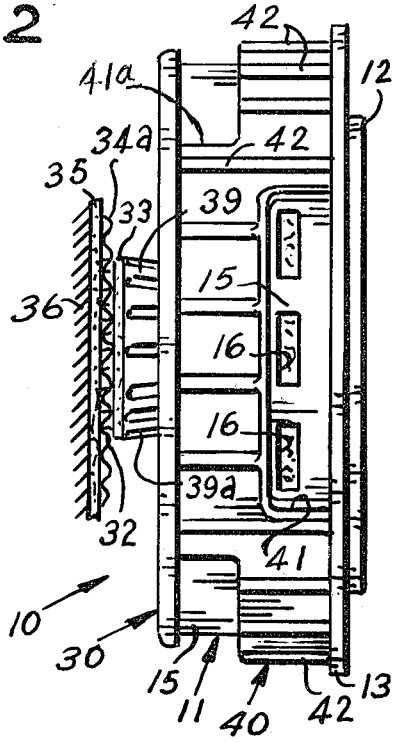
FIG. 2 is a right side view of FIG. 1 showing one set of ports fully uncovered for moisture-supplying operation, further showing removal of protective tape from the fastener strip of the device and illustrating the invention as secured to the interior of an instrument case, the case being shown fragmentarily and in section.
Figure 3:
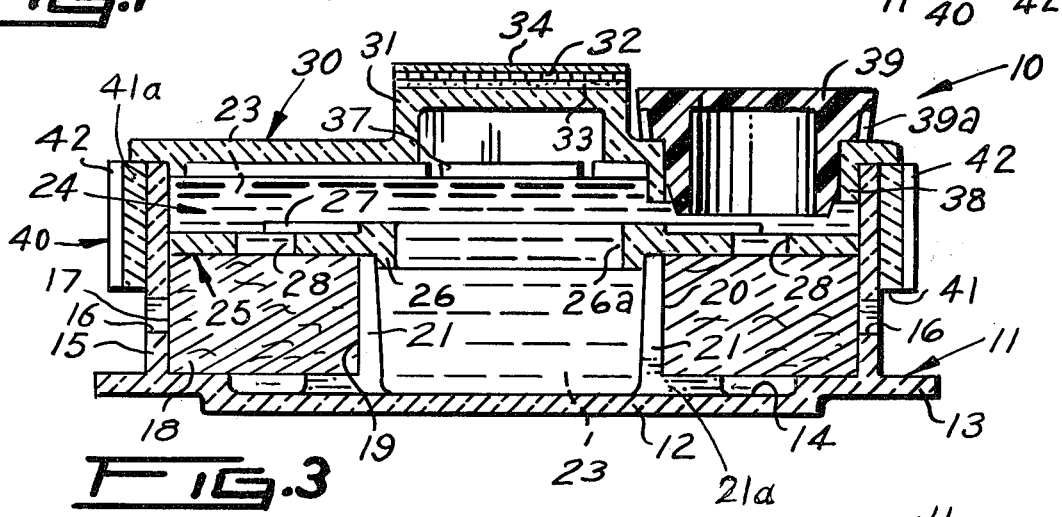
FIG. 3 is an enlarged cross-sectional view of the device taken along the plane 3-3 of FIG. 1.

In accordance with the invention and the preferred form shown, the humidifier device generally indicated by numeral 10 is comprised of a circular, relatively shallow housing generally indicated by numeral 11 and may be of any suitable, transparent, rigid and inert material including the styrenes and acrylics. Housing 11 as best seen in FIGS. 2 and 3, consists of a bottom wall 12 comprised of an annular outside skirt or flange 13 and an adjacent and inner concentric recessed or well portion 14. Flange 13 extends from the housing peripheral or outer wall 15, said wall 15 adjacent the lower edge having diametrically opposed sets of ports or apertures 16 for communication with the outer periphery 17 of humectant ring 18, the latter being comprised of a suitable liquid-absorbing material and being adapted to fit and be suitably received and retained within the housing 11.

Figure 4:
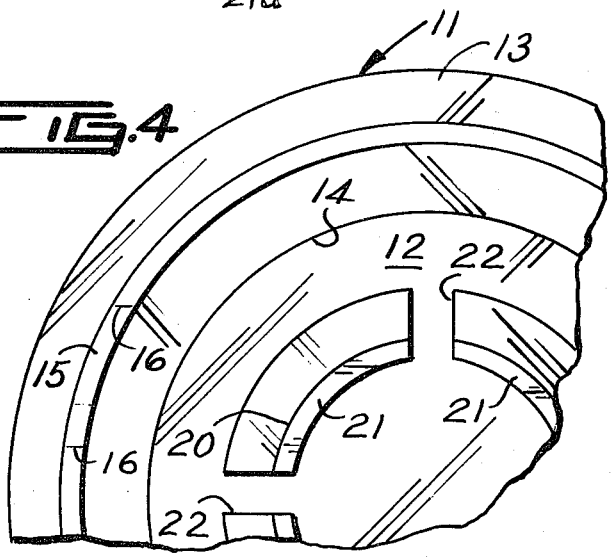
FIG. 4 is a fragmentary top plan view of the housing of the device per se with parts removed from the assembly.

Thus, ring 18, formed of any suitable and packed liquid-absorbent fibrous material including asbestos, is adapted to sit over the well or recessed portion 14 of housing bottom wall 12 and be engagingly held at its outer periphery by the inner face of housing outer wall 15, and at its inner periphery 19 by the outer face or periphery 20 of a circular-forming housing inner wall. As best seen in FIG. 4, said housing inner wall is formed from a plurality of spaced arcuate wall sections each indicated by numeral 21 and each having attaching horizontal base legs 21*a* for securement to the housing floor 12 at the recessed portion 14.

Spacing 22 defined between the arcuate wall portions and legs 21 and 21*a* respectively provide passageways for water 23 or other suitable liquids received in the housing reservoir portions 24 to enter the bottom wall and inner periphery 19 of ring 18 (see FIGS. 3 and 4), said bottom wall of ring 18 being disposed above housing well 14 as heretofore stated and being supported by legs 21*a* and a portion of housing bottom wall 12. The passageways for the top wall of ring 18 will be described next in connection with the retaining plate 25 for ring 18, but all of such passageways offer entry of reservoir water 23 to three sides of ring 18 for evaporation therefrom through the ports or apertures 16 of housing wall 15 to the surrounding air of the device 10.

Thus, passageways for reservoir water 23 to the top wall of ring 18 is afforded by the said retaining plate 25 as best seen in FIG. 6. Plate 25 is of circular configuration, is also formed of suitable clear plastic material and includes a hub portion 26, the latter being adapted to be received within the confines of housing inner wall portions 21. Plate 25 further includes a plurality of equally and radially spaced-apart rib portions 27 to afford rigidity thereto and an arcuate opening 28 between each pair of said rib portions to enable water or other fluid 23 to enter and be absorbed by ring 18 through the top wall thereof. Moreover, opening 26*a* through hub portion 26 provides passageway means for water 23 to enter the area between inner housing wall portions 21 and the recess 14 beneath the ring 18 (see FIG. 3).

Retaining plate 25 as shown is secured to the inner wall members 21 of housing 11 during the manufacture of the humidifier device 10 along the upper edges thereof (see FIG. 7) by means of an annular ring 29 integrally attached to the underside of plate 25 serving as an energy director for ultrasonically welding same to the inner wall members 21. Plate 25 thus is adapted to fix ring member 18 within the compartment formed by the described housing parts.

Figure 5:
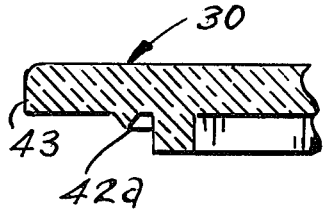
FIG. 5 is an enlarged fragmentary view in elevation of the top cover of the housing and prior to being secured to the assembly.

Closure for the housing assembly of the device 10 is afforded by a top cover 30 (see FIGS. 3 and 5) formed of suitable clear plastic material as best seen in FIGS. 3 and 5 and includes a hollow neck portion 31 extending upwardly from the center of its top wall. Cover 30 is adapted to be hermetically sealed to the assembly of housing 11 as will appear hereinafter and further carries the attaching means of the device for securement to the musical case or other internal area used to house the same. Said attaching means as best seen in FIG. 2 may be conventional and as shown is secured to the top wall of cover neck portion 31. Thus, the fastener strip 32, common in the art, is secured to the top surface of the top wall of neck portion 31 by a suitable adhesive 33. And prior to using the humidifier device 10, a protective strip of tape 34 is secured to the top of strip 32. Fastener strip 32 is of the hook type and its mating strip 34*a* is of the loop type, the latter being secured by an adhesive 35 to the interior surface 36 of a musical instrument case or other surface. Magnetic or other detachable means of attachment of the device 10 may also be resorted to.

Top cover 30 includes in addition radially disposed and spaced reinforcing ribs 37 to maintain rigidity of said cover and a second neck portion 38 extending downwardly into one of the liquid reservoir portions 24 (see FIG. 3). Neck portion 38 is adapted to receive a closure cap 39 preferably of resilient polyethylene or similar plastic for hermetical and frictional sealing purposes following filling and refilling of reservoir portions 24 of housing 11 with water or other fluid 23.

Provision for controlling the amount of moisture to be imparted to the surrounding atmosphere of the humidifier device 10 is in the form of a control ring 40 of suitable, rigid and transparent plastic material and includes a pair of diametrically opposed and elongated openings or cut-outs 41 registrable with housing outer wall ports 16. Ring 40 is rotatably mounted against housing outer wall 15 and between housing bottom wall flange 13 and the protruding edge of top cover 30 as seen best in FIGS. 2 and 3. Mounting of control ring 40 is effectuated in manufacture after absorbent ring retaining plate has been secured over absorbent ring 18 within housing 11 and prior to hermetical sealing of top cover 30 to housing outer wall 15. Following said mounting, proper hermetical sealing of top cover 30 to housing 11 takes place. As shown, sealing is accomplished by use of an annular ring 42*a* integrally attached to the underside of cover peripheral flange portion 43, said ring 42*a* serving as an energy director for a peripheral ultrasonic welding. It is to be observed that control ring 40 as shown is provided with a pair of opposed cut-outs 41*a* to faciltate finger rotation of said ring for adjustability thereof.

As shown, the outer periphery of the cap 39 serving as a removable closure for mouth or neck portion 38 is provided with vertical grooves 39*a* for easy finger gripping, while the outer periphery of control ring 40 also includes a plurality of raised portions 42 also for easy finger gripping.

MODE OF OPERATION

With respect to the mode of operation of the humidifier device 11 as described, closure cap 39 is removed from mouth or neck 38 for introduction of water or other fluid 23. Said fluid will travel into the resservoir portions 24 and then enter openings 28 of retaining plate 25 and passageways 22 between the arcuate housing inner wall portions 21 and 21*a*. Thus absorbent ring 18 becomes exposed to reservoir fluid from the upper, inner and bottom sides (see FIG. 3). At such time water or other fluid will escape from ring 18 if housing ports 16 are exposed by the positioning of the control ring 40 until cap 39 is reintroduced into neck 38. Such reintroduction prevents water flow from ring 40 and allows water evaporation therefrom.

For attachment of the humidifier device 10 to the interior of the musical instrument case or other area requiring humidification, tape 34 of the attaching means is peeled from fastener 32 after suitably adhering a mating second fastener strip 34*a* to the surface 36 of the interior of a closed area requiring a humectant. Thereafter, the device is pressed with its fastener strip 32 against fastener 34*a*.

To refeed device 10 wih liquid or water 23 after the latter has been consumed by evaporation, it is pulled free from mating fastener 34*a* and cap or plug 39 is removed. After such refill, plug 39 is reintroduced and device 10 is reattached as heretofore described.

To render the device leak-proof for vacuum action, top cover 30 should heremetically seal housing 11 and for this reason a preferred type of sealing has been herein described. Thus when water or other fluid 23 starts to evaporate from ring 18 through ports 16, a vacuum is created in the interior of housing 11 thereby causing plug 39 to be forced inwardly of neck or mouth 38 for tighter frictional and sealing engagement.

Thus, the humidifier device 10 as described provides a sealed unit, means for greater wetting and absorption the humectant ring 18, resultant increase in capacity of evaporation for size of the device, reservoir liquid in contact with ring 18 practically in all positions of the device, and further provides a compact and durable unit.

MODIFIED FORM OF DEVICE

Referring to FIGS. 8 and 9 of the drawings, a modified form of top cover 44 is provided and includes a center hub 45 adapted to frictionally receive a suitable plug (not shown). Cover 44 includes a plurality of radially and equally spaced ribs 46 for rigidity and further includes a ring 47 similar to rings 29 and 42*a* of retaining plate 25 and top cover 30 respectively to serve as an energy director during manufacture of the device as has heretofore been described. In use, cover 44 is similar to cover 30 except that the closure plug is frictionally received in hub 45, the latter being the center refill portion of a humidifier device rather than as an offset portion as shown in the other drawing figures. Said closure plug is adapted to have on its top wall similar attaching means for the device as is shown in FIG. 2 in connection with cover neck portion 31.

Transparency of the device 10 with respect to the parts thereof as described permits visibility of the interior so that need for filling or recharge with fluid may easily be observed.

I wish it understood that minor changes and variations in materials, size, location, assembly and integration of parts may all be resorted to without departing from the spirit of the invention and the scope of the appended claims.

I claim:

1. In a humidifier device, the improvement comprising in combination:

a relatively flat cylindrical housing having apertures along its peripheral wall and having a central, concentric depressed portion on its bottom wall;

an absorbent ring mounted on said bottom wall and spaced above said depressed portion and covering said apertures, said ring being adapted to hold water or other evaporatable fluid;

a retaining ring secured to said housing and abutting the top wall of said absorbent ring for maintaining said absorbent ring in position;

an adjustable control ring rotably secured around said housing for regulating evaporation of said fluid through said housing apertures; and a housing cover secured to said housing and spaced above said retaining ring and having a fluid filler opening and a stopper therefor.

2. In a humidifier device as set forth in claim 1 wherein a plurality of arcuate inner housing wall members are equally and radially spaced apart, said inner wall members each having base flanges attached to the bottom wall of said housing at the depressed portion, thereby providing compartment means for confining said absorbent ring between said inner wall members and the peripheral wall of said housing.

3. In a humidifier device as set forth in claim 2 wherein the inner periphery of said absorbent ring engages with the outer peripheries of said plurality of arcuate wall members, and wherein the outer periphery of said absorbent ring enages with the inner side of said housing peripheral wall, and wherein the bottom wall of said absorbent ring is engaged by the base flanges of said inner wall members and a bottom wall portion of said housing.

4. In a humidifier device as set forth in claim 3 wherein said apertures in the housing peripheral wall comprise a plurality of spaced ports penetrating said peripheral wall for air to enter and cause evaporation of water or other fluid to take place and impart moisture to the area surronding said device.

5. In a humidifier device as set forth in claim 4 wherein said retaining ring is affixed to the tops of said inner wall members and is provided with a plurality of radially spaced apart openings to provide passageway means for the flow of water or other fluid from the upper portion of said housing into said absorbent ring, and said housing cover being affixed peripherally to the upper edge of the housing peripheral wall in seal-tight engagement therewith.

6. In a humidifier device as set forth in claim 5 wherein said cover includes an opening for receiving water or other fluid, and further includes a cap to frictionally close said opening.

7. In a humidifier device as set forth in claim 6 wherein said adjustable control ring is freely and adjustably engageable on the outer side of the housing peripheral wall and includes a plurality of cut-outs adjacent the lower edge for exposing said plurality of spaced ports in the housing peripheral wall, said adjustable control ring being adapted to cover and uncover said plurality of spaced ports when desired by rotating said adjustable control ring in either direction to attain desired degree of humidity in the area surrounding the device.

8. In a humidifier device as set forth in claim 7 wherein said housing cover and said housing bottom wall each have a peripheral flange facing each other and adapted to engage the upper and lower peripheral edges of the said adjustable control ring therebetween for confining and retaining said adjustable control ring.

* * * * *